United States Patent [19]

Smith

[11] Patent Number: 4,900,075

[45] Date of Patent: Feb. 13, 1990

[54] AUXILIARY SAFETY CHAIN LOCKING DEVICE

[76] Inventor: William C. Smith, 1540 Millrace, Rochester Hills, Mich. 48064

[21] Appl. No.: 230,068

[22] Filed: Aug. 9, 1988

[51] Int. Cl.[4] ..... E05C 17/36

[52] U.S. Cl. ..... 292/263; 292/264; 292/268; 292/288; 70/93

[58] Field of Search ..... 70/14, 17, 18, 19, 59, 70/93; 292/264, 268, 269, 270, 263, 288, 205, 329, 328, 330, 331, 289, 290, 297, 298

[56] References Cited

U.S. PATENT DOCUMENTS

| | | | |
|---|---|---|---|
| 339,883 | 4/1886 | Hawes . | |
| 1,439,111 | 12/1922 | Laney . | |
| 1,479,709 | 1/1924 | Goldstein | 292/264 |
| 1,510,562 | 10/1924 | Segol | 292/264 |
| 1,612,728 | 12/1926 | Johanning . | |
| 2,264,669 | 12/1941 | Kessler | 292/264 |
| 2,995,919 | 8/1961 | Davis . | |
| 3,071,958 | 1/1963 | Russo . | |
| 3,101,603 | 8/1963 | North et al. . | |
| 3,125,875 | 3/1964 | Friedman . | |
| 3,134,252 | 5/1964 | Mintz . | |
| 3,161,035 | 12/1964 | Adamec et al. . | |
| 3,275,364 | 9/1966 | Quinn . | |
| 3,521,922 | 7/1970 | Bowling | 292/264 |
| 3,657,908 | 4/1972 | Schwartz et al. . | |
| 3,667,259 | 6/1972 | Reque et al. . | |
| 3,667,794 | 6/1972 | Lentz, Jr. . | |
| 3,705,504 | 12/1972 | Johnson . | |
| 3,762,752 | 10/1973 | Saunders . | |
| 3,763,673 | 10/1973 | Colombo et al. . | |
| 3,788,107 | 1/1974 | Lippman | 292/264 |
| 4,013,311 | 3/1977 | Prezioso | 292/264 |
| 4,017,104 | 4/1977 | Walker . | |
| 4,027,908 | 6/1977 | Crepinsek . | |
| 4,085,599 | 4/1978 | Fischer et al. . | |
| 4,106,800 | 8/1978 | Nakanishi . | |
| 4,192,537 | 5/1980 | Laine . | |
| 4,229,030 | 10/1980 | Tarragona Corbella . | |
| 4,452,476 | 6/1984 | Stole | 292/264 |
| 4,472,143 | 9/1984 | Bennett et al. . | |
| 4,482,177 | 11/1984 | Nagy | 292/264 |
| 4,683,729 | 8/1987 | Rogers . | |

FOREIGN PATENT DOCUMENTS

| | | | |
|---|---|---|---|
| 21541 | 7/1929 | Australia . | |
| 346278 | 12/1921 | Fed. Rep. of Germany . | |
| 175600 | 5/1935 | Switzerland . | |
| 22135 | of 1911 | United Kingdom . | |
| 21844 | of 1913 | United Kingdom . | |
| 1596183 | 11/1926 | United Kingdom | 292/268 |

*Primary Examiner*—Gary L. Smith
*Assistant Examiner*—Eric K. Nicholson
*Attorney, Agent, or Firm*—Harness, Dickey & Pierce

[57] ABSTRACT

An auxiliary safety chain device for securing stud/loop retainer safety latching type devices is disclosed. The device includes a stud securement member secured to the stud of the safety latch device. A coupling member is coupled with the loop retainer. A locking mechanism secures the coupling member and the stud securement member together to lock the device.

11 Claims, 1 Drawing Sheet

AUXILIARY SAFETY CHAIN LOCKING DEVICE

BACKGROUND AND SUMMARY OF THE INVENTION

The present invention relates to locking devices and, more particularly, to portable auxiliary locking devices to lockably secure safety latches of the stud/loop retainer type.

When travelling or vacationing, the traveller or vacationer generally encounters the dilemma of leaving his hotel room with the room door locked with just the issued hotel key. Several hotel personnel may have access to the keys that enable entrance, authorized or unauthorized, to the hotel room along with the traveler. Also, it is possible for others, such as thieves or the like, to obtain master keys to procure unauthorized entrance into the travelers hotel room.

Generally in hotel rooms, there is a secondary door lock of the safety chain variety mounted on the door and the jamb. However, these locks are ordinarily only securable when the traveller is present in his room. Locks do exist that lockably secure safety chain latch devices, however, these locks are permanent or nonuniversal in adapting to safety chain devices. Relevant art devices for locking safety chain latches are illustrated in the following patents. The relevant art patents are U.S. Pat. Nos. 2,995,919; 3,125,875; 3,134,252; 4,192,537 and British Pat. Nos. 22,135 and 21,844.

While the above patents illustrate safety chain latch locking devices, they have several disadvantages. One disadvantage is that the locking mechanism is permanently secured to the door or jamb and the traveler would be issued a key from the hotel establishment and thus, the traveler would have the same problem as explained above. Another disadvantage is that some of the above patents require special attachments to secure the lock to conventional safety chain latch mechanisms.

Accordingly, it is an object of the present invention to overcome the disadvantages of the above art. The lock of the present invention provides the art with a portable auxiliary lock for safety latches of the stud/-loop retainer type. The present invention is easily coupled with the stud and loop of these types of safety locking devices. The present invention is compact and easily carried by the traveller. Further, the present invention enables the traveler to have his own personal lock and key to secure his hotel room, eliminating unauthorized entrances into his room by others that may have keys to the hotel room door.

From the subsequent description and the appended claims taken in conjunction with the accompanying drawings, additional objects and advantages of the present invention will become apparent to those skilled in the art.

BRIEF DESCRIPTION OF THE PREFERRED EMBODIMENT

Figure 1:
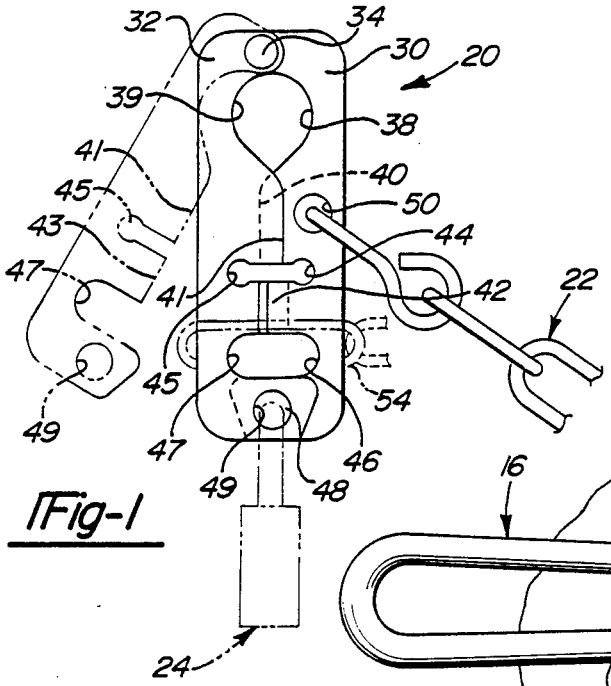
FIG. 1 is a side elevation view of a securement looking member of an auxiliary safety chain locking device in accordance with the present invention.

Turning to the figures, an auxiliary safety latch locking device is illustrated and designated with the reference numeral 10. Particularly, in FIG. 3, the auxiliary device 10 is illustrated secured to a safety latch of the stud/loop retainer type. The safety latch device includes a stud 12 with a spherical head 14, ordinarily secured on the door, and a retaining loop 16, secured to the jamb. The auxiliary device 10 includes a stud securement locking member 20, a coupling member 22 and a locking mechanism 24.

The stud securement mechanism 20 includes a pair of members 30 and 32. The members 30 and 32 are rotatably secured together by pin 34 as best seen in FIG. 1. The pin 34 enables the members 30 and 32 to move in a scissors action with respect to one another. The members 30 and 32 are substantially similar and the discussion will apply to both.

Figure 3:
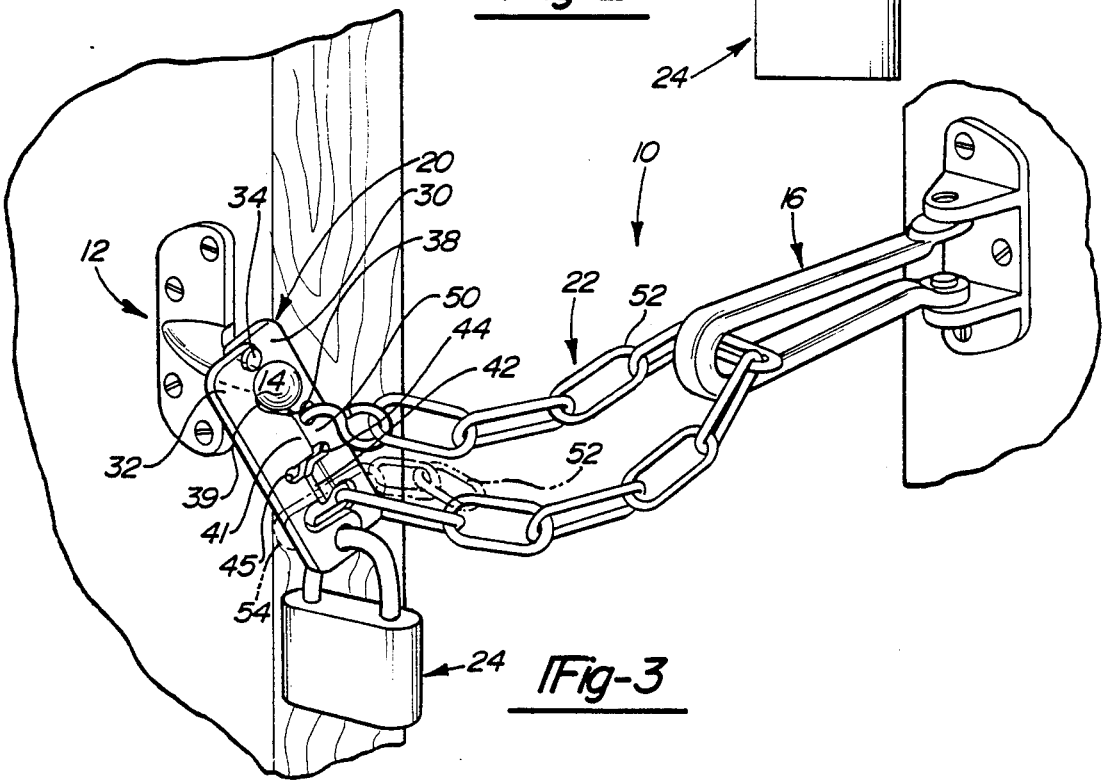
FIG. 3 is a perspective view of the device in accordance with the present invention.

The members 30 and 32 include arcuate slots 38 and 39 which, when the two members are closed as in FIG. 1, form a circular aperture to retain the stud head 14 within the members 30 and 32, as seen in FIG. 3.

Figure 2:
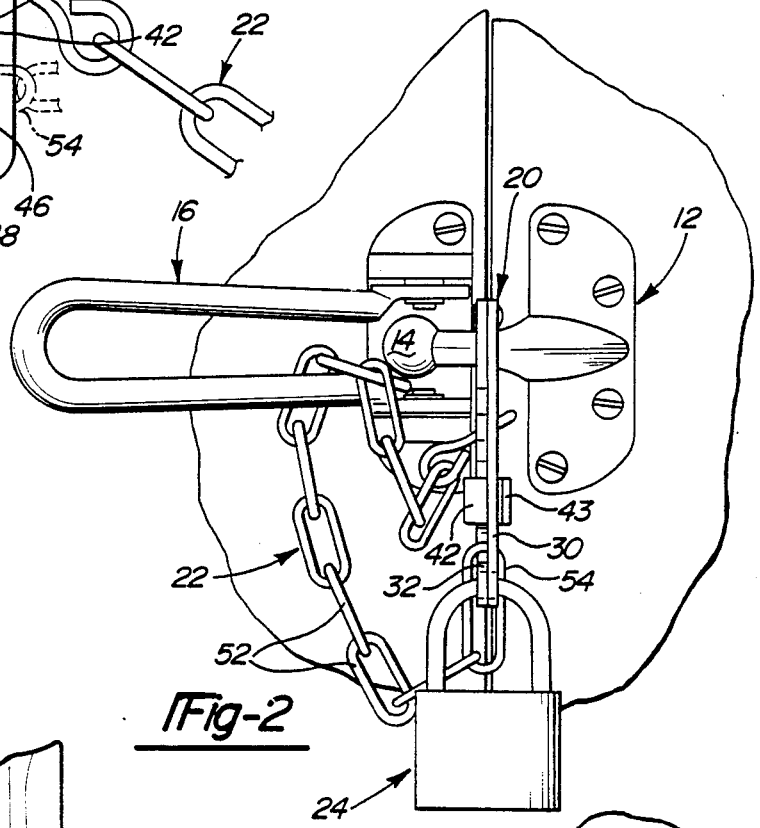
FIG. 2 is a side elevation view of the device in accordance with the present invention.

The members 30 and 32 each include a pair of interlocking fingers 40, 41, 42 and 43. The first pair of interlocking fingers 40 and 41 are adjacent to the arcuate slots 38 and 39. Generally, these fingers are substantially flat. The second pair of fingers 42 and 43 are adjacent to the first pair of fingers above a separation gap 44 and 45 and the members 30 and 32. The second pair of fingers angularly depart from the members 30 and 32 as seen in FIG. 2. Both sets of fingers provide additional strength to the members 30 and 32 against prying by an unauthorized entrant.

A second arcuate slot 46 and 47 is formed in each of the members 30 and 32. The second arcuate slots 46 and 47 retain the coupling device 22 within the members 30 and 32. A pair of apertures 48 and 49 are in each of the members 30 and 32. The locking mechanism 24 is positioned through the apertures 48 and 49, as seen in FIG. 3.

When the members 30 and 32 are closed upon one another, the auxiliary device 10 has a substantially rectangular shape, as seen in FIG. 1. The auxiliary device 10 is formed from strong, lightweight materials to enable easy carrying of the device. The member 30 includes an aperture 50 to enable the coupling mechanism 22 to be coupled therewith.

The coupling mechanism 22 is generally a linked chain. The links 52 are of a desired size so that the links can easily be trapped within the slots 48 and 49 of members 30 and 32 as seen in FIG. 3. Also, the chain may include a larger link 54 that is positioned over closed members 30 and 32, as shown in phantom in FIGS. 1 and 3, to enable the locking mechanism 24 to secure the link 59 over the member 30 and 32. A strap having rugged characteristics could be substituted for the chain 22. A strap made out of nylon, kevlar or the like could be substituted therefore with a loop to enable the members 32 and 34 to secure the loop therein.

The locking mechanism 24 is generally comprised of a padlock being of the keyed or combination type. The lock is generally like those obtained in hardware stores or the like.

To position the auxiliary device 10 onto the stud 12, the members 30 and 32 are pivoted, as shown in phantom in FIG. 1. With the device in an open position, the arcuate slots 38 and 39 are positioned behind the head 14 of the stud 12. The chain 22 is slipped through the loop retainer 16, as shown in FIGS. 2 and 3. The chain is then secured in the slots 46 and 47. The members 30 and 32 are closed together so that the slots 38 and 39 form the circular aperture around the head 14 of the stud 12 as see in FIG. 3. The locking mechanism 24 is positioned within the apertures 48 and 49 to securely lock the auxiliary device 10. In the case where the link 54 is positioned over the members 30 and 32, the members 30 and 32 would be closed onto the head 14 and the link 54 positioned over the members 30 and 32, and then the lock 24 placed thereon.

While the above detailed description describes the preferred embodiment of the present invention, it will be understood that the present invention is susceptible to modification, variation and alteration without deviating from the scope and fair meaning of the subjoined claims.

What is claimed is:

1. An auxiliary door safety latch device comprising:

means adapted for securing to a stud means;

means adapted for coupling said securing means with a door stud retainer;

means adapted for locking and unlocking said coupling means with said securing means such that said auxiliary door safety latch device when secured to a door stud means and stud retainer enables the door to open without providing access through the door until said locking means is decoupled from said securing means and coupling means enabling limited access through the door; and said securing means, coupling means and locking means being readily removable from one stud means and stud retainer to another stud means and stud retainer so that said auxiliary door safety latch device is portable enabling a user to travel with said auxiliary door safety latch device to enable said auxiliary door safety latch device to be associated with a plurality of stud means and door stud retainers.

2. The auxiliary safety latch lock as in claim 1 wherein said securing means is comprised of a pair of members rotatably secured together, said members each have a recess and move in a scissor action to enable the recesses to clamp on the stud.

3. The auxiliary safety latch lock as in claim 2 wherein each of said members include an aperture for enabling passage of said locking means through said members.

4. The auxiliary safety latch lock as in claim 3 wherein each of said members further include overlapping portions for increased strength of said members.

5. The auxiliary safety latch lock as in claim 4 wherein said coupling means is comprised of a chain.

6. The auxiliary safety latch lock as in claim 5 wherein said members have a recess for retaining said chain within said members.

7. An auxiliary lock for a safety door lock of a stud and loop retainer type, the auxiliary lock comprising:

a pair of substantially flat members, said members pivotally secured together so that the members move in a scissor action with respect to one another;

means for securing the stud to said members, said securing means coupled with at least one of said members;

a chain coupled with one of said members, said chain having a desired length and a link size enabling said chain to pass through a loop retainer;

means for retaining said chain, said retaining means associated with at least one of said members; and means for locking said chain with said members, said locking means locking said chain and members together in a use position.

8. The auxiliary lock according to claim 7 wherein said stud securing means is comprised of an arcuate slot in each of said members such that said arcuate slots oppose one another in a use position forming a circular aperture.

9. The auxiliary lock according to claim 7 wherein each of said members further include one or more fingers interlocking with each other to provide said members with additional strength.

10. The auxiliary lock according to claim 7 wherein said locking means is comprised of a key or combination padlock or the like.

11. An auxiliary safety latch device for safety latches of a stud and loop retainer type safety latches, comprising:

means adapted for securing to a stud of the safety latch;

means adapted for securing to a loop retainer, said loop retaining securing means coupled with said stud securing means;

means adapted for locking and unlocking said loop retaining securing means and said stud securing means such that when in use, said locking means non-removably couples said loop retaining securing means and said stud securing means together; and said stud securing means, loop retainer securing means and locking means being readily removable from one stud and loop retainer to another stud and loop retainer so that said auxiliary door safety latch device is portable enabling a user to travel with said auxiliary door safety latch device to enable said auxiliary door safety latch device to be associated with a plurality of studs and loop retainers.

* * * * *